US008720649B2

(12) United States Patent
Jokinen

(10) Patent No.: US 8,720,649 B2
(45) Date of Patent: May 13, 2014

(54) METHOD IN CONNECTION WITH AN ELEVATOR SYSTEM HAVING TORQUE IMPULSES AND AN ELEVATOR SYSTEM THEREOF

(75) Inventor: Risto Jokinen, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 66 days.

(21) Appl. No.: 13/466,442

(22) Filed: May 8, 2012

(65) Prior Publication Data

US 2012/0217097 A1 Aug. 30, 2012

Related U.S. Application Data

(63) Continuation of application No. PCT/FI2010/050884, filed on Nov. 3, 2010.

(30) Foreign Application Priority Data

Nov. 10, 2009 (FI) ..... 20096171

(51) Int. Cl.
*B66B 1/34* (2006.01)

(52) U.S. Cl.
USPC ..... 187/393; 187/293

(58) Field of Classification Search
USPC ..... 187/247, 391–393, 277, 293–297; 318/466–470, 432
See application file for complete search history.

(56) References Cited

U.S. PATENT DOCUMENTS

| | | | | | |
|---|---|---|---|---|---|
| 4,928,021 | A * | 5/1990 | Yonemoto | 187/288 |
| 5,384,675 | A * | 1/1995 | Crawforth et al. | 360/75 |
| 5,397,971 | A * | 3/1995 | McAllister et al. | 318/400.35 |
| 5,635,688 | A * | 6/1997 | Kantesaria et al. | 187/292 |
| 5,821,478 | A * | 10/1998 | Schroder-Brumloop et al. | 187/316 |
| 6,064,165 | A * | 5/2000 | Boisvert et al. | 318/465 |
| 6,239,563 | B1 * | 5/2001 | Kunz | 318/400.07 |
| 6,364,066 | B1 * | 4/2002 | Bolch et al. | 187/391 |
| 7,448,473 | B2 * | 11/2008 | Lindberg et al. | 187/392 |
| 7,823,706 | B2 * | 11/2010 | Tyni et al. | 187/393 |
| 8,069,958 | B2 * | 12/2011 | Lence-Barreiro | 187/393 |
| 2003/0000777 | A1 * | 1/2003 | Lence Barreiro et al. | 187/391 |
| 2004/0183493 | A1 * | 9/2004 | Boisvert et al. | 318/469 |

FOREIGN PATENT DOCUMENTS

| | | | |
|---|---|---|---|
| JP | 11-308833 | A | 11/1999 |
| JP | 2005-35746 | A | 2/2005 |
| JP | 2008-230757 | A | 10/2008 |
| WO | WO-2005/102898 | A1 | 11/2005 |
| WO | WO-2010/063650 | A1 | 6/2010 |

OTHER PUBLICATIONS

International Search Report PCT/ISA/210, Nov. 2010.

* cited by examiner

*Primary Examiner* — Anthony Salata
(74) *Attorney, Agent, or Firm* — Harness, Dickey & Pierce, P.L.C.

(57) ABSTRACT

The invention relates to an elevator system and also to a method for detaching an elevator car and/or a counterweight from a safety gear. In the method torque pulses are produced with the hoisting machine of an elevator, for detaching a gripped stuck elevator car and/or a gripped stuck counterweight.

22 Claims, 4 Drawing Sheets

METHOD IN CONNECTION WITH AN ELEVATOR SYSTEM HAVING TORQUE IMPULSES AND AN ELEVATOR SYSTEM THEREOF

CROSS REFERENCE TO RELATED APPLICATIONS

This application is a continuation of International Application Number PCT/FI2010/050884 filed on Nov. 3, 2010 and claims priority to Finnish Application Number FI 20096171 filed on Nov. 10, 2009, the entire contents of each of which are hereby incorporated herein by reference.

FIELD OF THE INVENTION

The invention relates to solutions for detaching a gripped stuck elevator car and/or counterweight.

BACKGROUND OF THE INVENTION

The safe operation of an elevator system is generally ensured with a safety gear that grips the guide rail. A safety gear can be used for stopping the elevator car or the counterweight. A safety gear can be activated for different reasons, such as owing to overspeed of the elevator car; a safety gear can also be activated e.g. when the elevator car is moving on service drive into a part of the elevator hoistway that is reserved as a working space of a serviceman. A safety gear can also be used e.g. to prevent the drifting of an elevator car with doors open from the stopping floor of the elevator. The frame of the safety gear is generally fixed in connection with the elevator car. The frame normally comprises a housing, which contains a braking surface towards the elevator guide rail, and inside which housing the elevator guide rail is disposed. Likewise the housing comprises a wedge or roller, which when the safety gear operates meets the elevator guide rail and is disposed on a track in the housing. The elevator guide rail is between the braking surface and the wedge or roller. The track is shaped such that when the wedge or roller moves on the track in the direction of the guide rail, the guide rail presses against the braking surface under the effect of the wedge or roller producing braking, which stops the elevator car. The safety gear generally stops downward movement of the elevator car; however, safety gears that operate upwards or in two directions are also known in the art.

The aforementioned wedge or roller of the safety gear is pushed on the track increasingly tighter against the guide rail as the gripping progresses. For detaching a gripped elevator car, the elevator car must be pulled in the opposite direction with respect to the propagation direction of the gripping. Owing to the operating principle of a safety gear, detaching a gripped elevator car generally requires a great deal of force. For this reason, a Tirak hoist or corresponding separate hoisting device has conventionally been used for detaching an elevator car.

SUMMARY OF THE INVENTION

For the reasons mentioned above, among others, the invention discloses an improved method and elevator system for detaching an elevator car and/or counterweight that is gripped tight. By means of the invention an elevator car and/or counterweight can be detached without a separate hoisting device or at least the dimensioning of the separate hoisting device needed can be essentially reduced.

In relation to the characteristic attributes of the invention, reference is made to the claims.

The first aspect of the invention relates to a method for detaching a gripped stuck elevator car, for detaching a gripped stuck counterweight, or for detaching both a gripped stuck elevator car and a gripped stuck counterweight.

According to one or more embodiments of the invention, torque impulses are produced with the hoisting machine of the elevator, for detaching a gripped stuck elevator car and/or a gripped stuck counterweight. When the current supplied to the hoisting machine for producing consecutive torque impulses is formed from essentially short consecutive current pulses, the heating of the hoisting machine and/or of the power supply apparatus of the hoisting machine caused by the current is also smaller than when supplying e.g. direct current to the hoisting machine for detaching a gripped stuck elevator car and/or counterweight. For this reason also the instantaneous value of the current and therefore the peak value of detaching torque can be increased. If the elevator car and/or counterweight is in this case detached without a separate hoisting device, using just the hoisting machine of the elevator, the detaching process can also, if necessary, be automated.

According to one or more embodiments of the invention, torque impulses are produced with the hoisting machine of the elevator, which torque impulses act on the elevator car and/or on the counterweight in the opposite direction with respect to the propagation direction of the gripping. In this case the detaching force produced by the torque impulses can be directed by means of the hoisting machine as efficiently as possible for detaching the elevator car and/or the counterweight.

According to one or more embodiments of the invention, the operation of the safety gear is observed and gripping of the elevator car and/or of the counterweight is deduced on the basis of the operation of the safety gear. The operation of the safety gear can be observed e.g. by measuring the state of a sensor, such as a safety switch, fitted in connection with the safety gear. An observation of the operation of the safety gear can also be used for monitoring the safety of the elevator system and e.g. for cancelling the gripping situation. The consequences of gripping can also be inspected e.g. by remote contact from a service center by means of camera monitoring.

According to one or more embodiments of the invention, information about the gripping of the elevator car and/or of the counterweight is sent to the service center. In this case the service center can also react quickly to a gripping situation.

According to one or more embodiments of the invention, torque impulses are produced with the hoisting machine of the elevator by supplying essentially pulse-like current to the hoisting machine of the elevator. A pulse-like current stresses the windings of the hoisting machine and/or the power supply apparatus of the hoisting machine, such as e.g. the power semiconductors of the frequency converter connected to the hoisting machine, less than a DC current of long duration.

According to one or more embodiments of the invention, the detaching function of a gripped stuck elevator car and/or of a gripped stuck counterweight is activated from the service center. A gripping situation can therefore be cancelled e.g. by starting the current supply with the power supply apparatus of the hoisting machine to the hoisting machine by remote control from the service center. In this case the gripping situation can be cancelled quickly. A gripping situation and cancellation of the situation can also, if necessary, be monitored from a service center e.g. with cameras disposed in the elevator hoistway, on the stopping floors and/or in the elevator car.

According to one or more embodiments of the invention, the detaching function of a gripped stuck elevator car and/or of a gripped stuck counterweight is activated with a user interface of the elevator control unit. The user interface can be disposed outside the elevator hoistway, such as e.g. on a stopping floor of the elevator or in the machine room, in which case the serviceman can release the gripping situation from outside the elevator hoistway.

According to one or more embodiments of the invention, consecutive torque impulses are produced at a frequency, which essentially corresponds to the resonance frequency of the mechanical vibration of the elevator system. Consecutive torque impulses at a resonance frequency load oscillation energy in a cumulative manner into the elevator mechanics, such as into the elevator car, into the suspension ropes and into a possible counterweight. In this case the detaching torque can, in other words, be magnified by utilizing the spring constants of the elevator ropes or elevator belts as well as of the other flexible parts and/or the oscillation energy loaded into the elevator mechanics.

According to one or more embodiments of the invention, the movement of the hoisting machine and/or of the elevator car produced by a torque impulse is measured, and the detaching function of the gripped stuck elevator car and/or of the gripped stuck counterweight is ended when the magnitude of the movement of the hoisting machine and/or of the elevator car increases over an ending limit. In this case the detaching function can be ended automatically on the basis of the measurement of the movement of the hoisting machine and/or of the elevator car.

According to one or more embodiments of the invention, the movement of the hoisting machine produced by a torque impulse is measured, and an individual torque impulse is disconnected when the speed of the hoisting machine decelerates to below a disconnection limit. In this case a torque impulse can be disconnected when the elongation of the elevator rope/belt progresses to the peak point of the amplitude of the elongation determined by the spring constant.

The second aspect of the invention relates to an elevator system.

According to one or more embodiments of the invention, the elevator system comprises an elevator car, a hoisting machine, for moving the elevator car in the elevator hoistway, a safety gear, for stopping the movement of the elevator car, a power supply apparatus, which is connected to the hoisting machine, for producing torque with the hoisting machine, and also a controller, which is fitted in connection with the aforementioned power supply apparatus. The aforementioned controller is arranged to produce torque impulses with the hoisting machine of the elevator, for detaching a gripped stuck elevator car.

According to one or more embodiments of the invention, the elevator system comprises a counterweight, a hoisting machine, for moving the counterweight in the elevator hoistway, a safety gear, for stopping the movement of the counterweight, a power supply apparatus, which is connected to the hoisting machine, for producing torque with the hoisting machine, and also a controller, which is fitted in connection with the power supply apparatus. The aforementioned controller is arranged to produce torque impulses with the hoisting machine of the elevator, for detaching a gripped stuck counterweight. When the current supplied to the hoisting machine for producing consecutive torque impulses is formed from essentially short consecutive current pulses, the heating of the hoisting machine and/or of the power supply apparatus of the hoisting machine caused by the current is also smaller than when supplying e.g. direct current to the hoisting machine for detaching a gripped stuck elevator car and/or counterweight. For this reason also the instantaneous value of the current and therefore the peak value of detaching torque can be increased. If the elevator car and/or counterweight is detached without a separate hoisting device, using just the hoisting machine of the elevator, the detaching process can also, if necessary, be automated. The elevator system can be provided with a counterweight or can be one without a counterweight. The hoisting machine of the elevator can also be a rotating motor or a linear motor.

According to one or more embodiments of the invention, the aforementioned controller is arranged to produce torque impulses with the hoisting machine of the elevator, which torque impulses act on the elevator car and/or on the counterweight in the opposite direction with respect to the propagation direction of the gripping. In this case the detaching force produced by the torque impulses can be directed by means of the hoisting machine as efficiently as possible for detaching the elevator car and/or the counterweight.

According to one or more embodiments of the invention, the elevator system comprises a rope or belt, for suspending the elevator car and/or counterweight in the elevator hoistway.

According to one or more embodiments of the invention, the controller comprises an input for the activation signal, and the controller is arranged to activate the detaching function of a gripped stuck elevator car and/or of a gripped stuck counterweight after receiving an activation signal. The detaching function can in this case be initiated in a controlled manner, e.g. from a user interface or from a service center.

According to one or more embodiments of the invention, the elevator system comprises an elevator control unit, and a data transfer channel is formed between the elevator control unit and the controller, for sending an activation signal from the elevator control unit to the controller. In this case the detaching function can be initiated by means of the control logic of the elevator control unit.

According to one or more embodiments of the invention, the elevator control unit comprises a user interface, and the detaching function of a gripped stuck elevator car and/or of a gripped stuck counterweight is arranged to be activated as a result of an activation command given from the user interface. The user interface can be disposed outside the elevator hoistway, such as e.g. on a stopping floor of the elevator or in the machine room, in which case the serviceman can release the gripping situation from outside the elevator hoistway.

According to one or more embodiments of the invention, the elevator control unit is connected to a service center with a data transfer line, and the detaching function of a gripped stuck elevator car and/or of a gripped stuck counterweight is arranged to be activated as a result of an activation command given from the service center. A gripping situation can therefore be cancelled e.g. by starting the current supply with the power supply apparatus of the hoisting machine to the hoisting machine by remote control from the service center. In this case the gripping situation can be cancelled more quickly than in prior art. A gripping situation and cancellation of the situation can also, if necessary, be monitored from a service center e.g. with cameras disposed in the elevator hoistway, on the stopping floors and/or in the elevator car.

According to one or more embodiments of the invention, the elevator control unit comprises a sensor that determines the operating status of the safety gear, and the elevator control unit comprises an input for the measuring signal of the aforementioned sensor that determines the operating status of the safety gear. The operation of the safety gear can be observed e.g. by measuring the state of a sensor, such as a safety switch, fitted in connection with the safety gear. An observation of the operation of the safety gear can also be used for monitoring the safety of the elevator system and e.g. for cancelling the gripping situation. The consequences of gripping can also be inspected e.g. by remote contact from a service center by means of camera monitoring. Information about the gripping can also be sent from the elevator control unit to the service center via a data transfer line, such as e.g. via a wireless link.

According to one or more embodiments of the invention, the aforementioned controller is arranged to produce with the hoisting machine of the elevator consecutive torque impulses at a frequency which essentially corresponds to the resonance frequency of the mechanical vibration of the elevator system. Consecutive torque impulses at a resonance frequency load oscillation energy in a cumulative manner into the elevator mechanics, such as into the elevator car, into the suspension ropes and into a possible counterweight. In this case the detaching torque can, in other words, be magnified by utilizing the spring constants of the elevator ropes or elevator belts as well as of the other flexible parts and/or the oscillation energy loaded into the elevator mechanics.

The aforementioned hoisting machine preferably comprises a permanent-magnet synchronous motor for producing the torque that moves the elevator car. The use of a permanent-magnet synchronous motor is preferred owing to, among other things, the good power-producing properties of a permanent-magnet synchronous motor.

The aforementioned summary, as well as the additional features and advantages of the invention presented below, will be better understood by the aid of the following description of some embodiments, said description not limiting the scope of application of the invention.

MORE DETAILED DESCRIPTION OF PREFERRED EMBODIMENTS OF THE INVENTION

Figure 1:
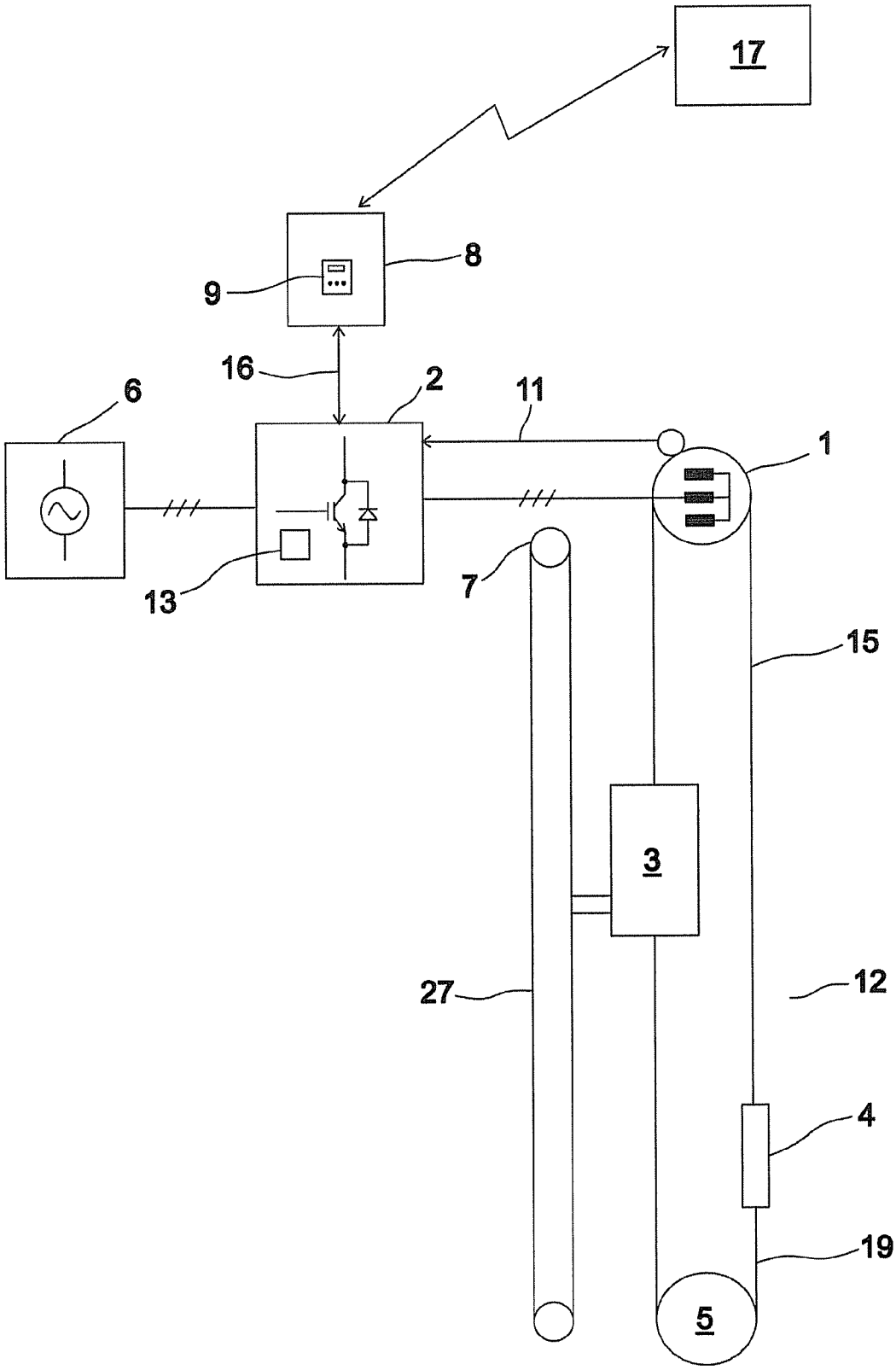
FIG. 1 presents an elevator system according to the invention, as a block diagram

FIG. 1 presents as a block diagram an elevator system, in which the elevator car 3 and the counterweight 4 are suspended in the elevator hoistway 12 with elevator ropes, a belt or corresponding 15 passing via the traction sheave of the hoisting machine 1. The torque that moves the elevator car 3 is produced with the permanent-magnet synchronous motor of the hoisting machine 1. The power supply to the permanent-magnet synchronous motor occurs during normal operation of the elevator from the electricity network 6 with a frequency converter 2. The frequency converter 2 comprises an inverter, which comprises an inverter control 13. With the inverter control 13 a variable-frequency and variable-amplitude current is supplied to the permanent-magnet synchronous motor by controlling the solid-state switches of the frequency converter with a switching reference formed by the inverter control 13. The frequency converter 2 adjusts the speed of the hoisting machine 1 towards the speed reference calculated by the elevator control unit 8. The elevator car is moved in the elevator hoistway according to the speed reference in response to elevator calls given from the stopping floors and from the elevator car. The elevator system of FIG. 1 also comprises one or more compensating ropes 19, which pass between the elevator car and the counterweight 4 via a diverting pulley 5 disposed in the bottom part of the elevator hoistway 12; the elevator system could, however, also be implemented without compensating ropes 19. By means of the compensating ropes 19, however, the weight difference caused by the mass of the elevator ropes, belt or corresponding 15 on different sides of the traction sheave of the hoisting machine 1 can be reduced. Compensating ropes 19 can also be used to prevent continuation of the movement of the counterweight 4 in connection with a sudden stop of the elevator car 3. Also a belt or corresponding can be used instead of a compensating rope.

Figure 2:
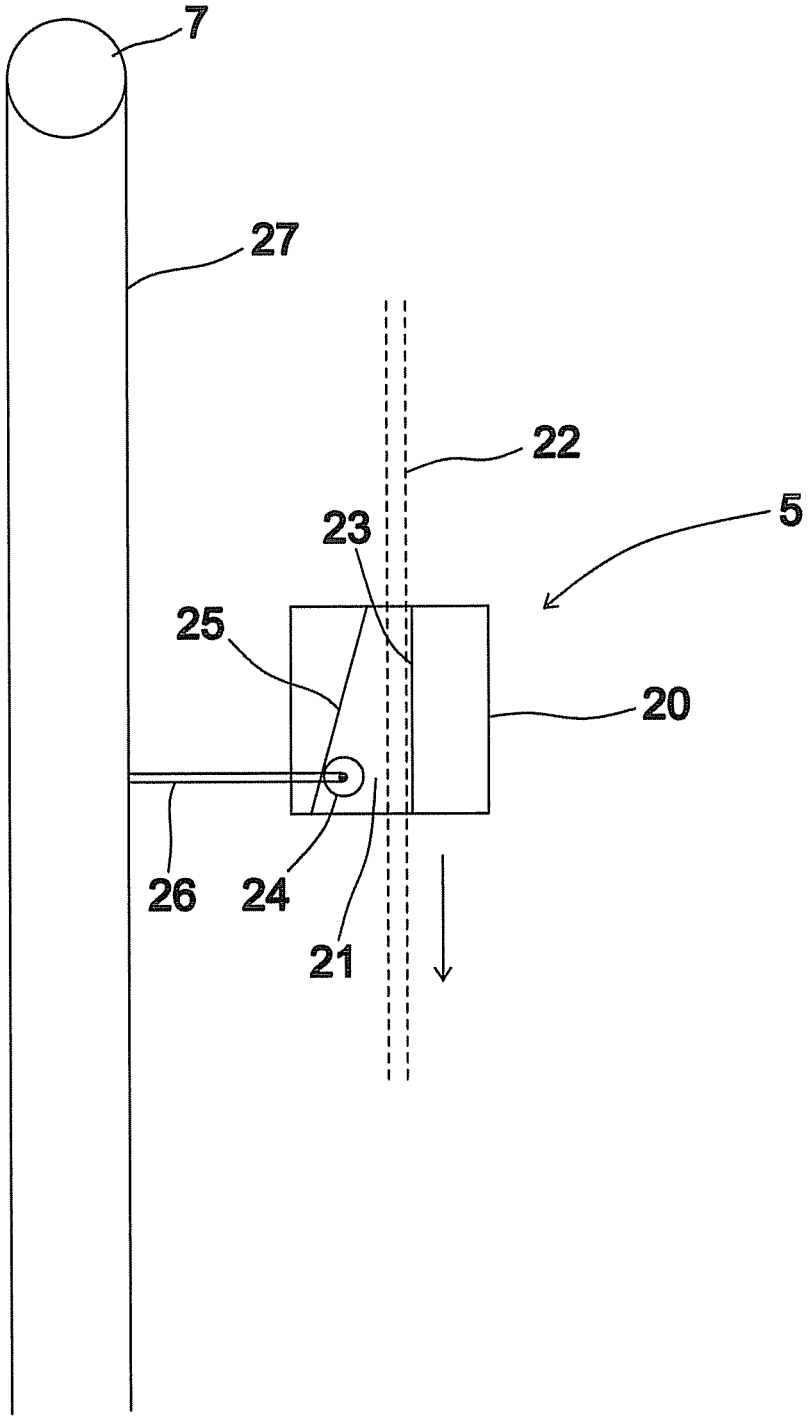
FIG. 2 illustrates one safety gear according to the invention

The elevator arrangement of FIG. 1 comprises as a safety device a safety gear 5 of the elevator car, with which safety gear movement of the elevator car 3 is stopped in a dangerous situation. In one embodiment of the invention the elevator system comprises as a safety device also a safety gear 14 of the counterweight, with which safety gear movement of the counterweight 4 is stopped in a dangerous situation. One operating principle of a possible safety gear 5 of an elevator car is illustrated in FIG. 2. The safety gear according to FIG. 2 can also be used in the elevator system of FIG. 1. The frame part 20 of the safety gear 5 is fixed in connection with the elevator car. The frame part comprises a housing 21, which contains a braking surface 23 towards the elevator guide rail 22, and inside which housing the elevator guide rail 22 is disposed. Likewise, the housing comprises a roller 24, which when the safety gear 5 operates meets the elevator guide rail 22 and is disposed on a track 25 in the housing. The elevator guide rail 22 is between the braking surface 23 and the roller 24. The track 25 is shaped such that when the roller 24 moves on the track 25 in the direction of the guide rail 22, the guide rail presses against the braking surface 23 under the effect of the roller 24 producing braking, which stops the elevator car. For example, the gripping of an elevator car moving downwards in the direction of the arrow as presented in FIG. 2 starts when the transmission means 26 that is in connection with the overspeed governor 7 of the elevator via the ropes 27 pulls the roller along the track 25 upwards to grip the guide rail. In practice this occurs by locking the movement of the ropes 27 with the overspeed governor 7 when the elevator car 3 moves, in which case the movement of the roller 24 along with the elevator car decelerates with respect to the moving track 25 and the roller moves into the gripping position in relation to the track 25.

Figure 3A:
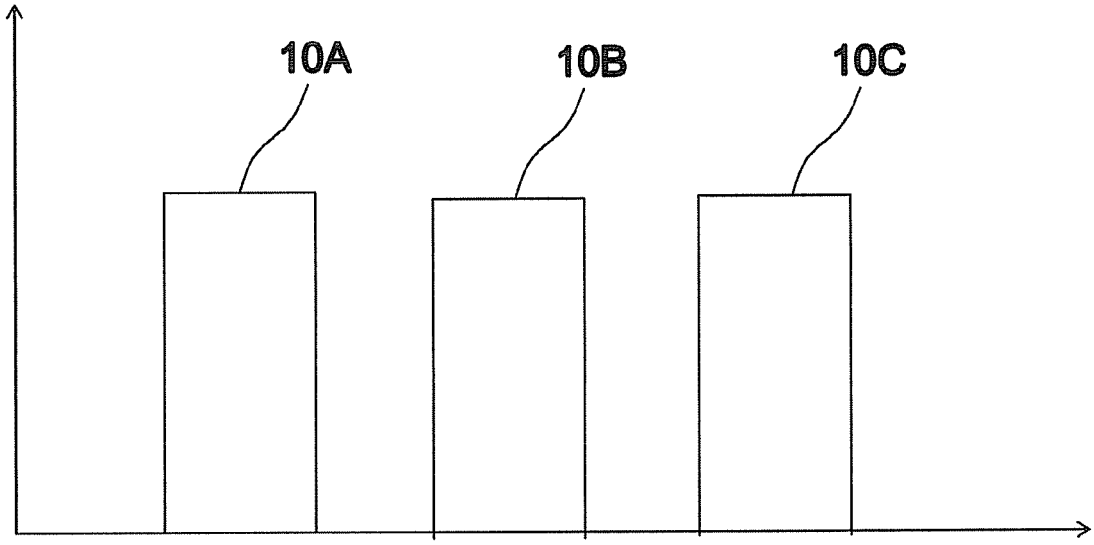
FIG. 3*a* illustrates torque impulses produced with the hoisting machine of an elevator
Figure 3B:
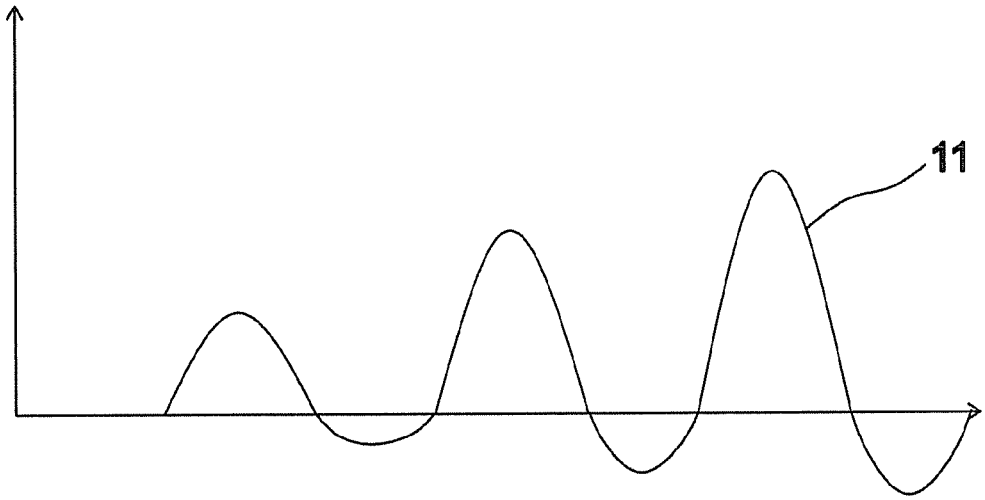
FIG. 3*b* illustrates the movement of the hoisting machine of an elevator as a response to the torque impulses produced with the hoisting machine of an elevator

For detaching an elevator car that was gripped when moving downwards, the elevator car must be pulled upwards, i.e. in the opposite direction with respect to the propagation direction of the gripping. Likewise, for detaching an elevator car that was gripped when moving upwards, the elevator car should be pulled downwards. In the elevator system of FIG. 1, torque impulses are produced with the hoisting machine 1 of the elevator, which torque impulses act on the elevator car 3 via the elevator ropes, belt or corresponding 15 in the opposite direction with respect to the propagation direction of the gripping. On the other hand, also the compensating ropes 19 could be used to transmit the detaching force that produces torque impulses. For producing torque impulses the frequency converter 2 supplies with the inverter control 13 short consecutive current pulses 10A, 10B, 10C according to FIG. 3*a* to the, permanent-magnet synchronous motor of the hoisting machine of the elevator in essentially a perpendicular direction with respect to the magnetization axis of the permanent-magnet synchronous motor, in which case the current pulses 10A, 10B, 10C to be supplied are directly proportional to the torque produced by the permanent-magnet synchronous motor. The duration of a current pulse 10A, 10B, 10C can be e.g. approx. 300 milliseconds and the current-free time between consecutive current pulses can be e.g. approx. 200 milliseconds. The current-free time between consecutive pulses/duration time of pulses can also be variable. The frequency of consecutive torque impulses of the motor produced by the current pulses 10A, 10B, 10C can also be selected to essentially correspond to the resonance frequency of the mechanical vibration of the elevator system. The use of the resonance frequency of the mechanical vibration is advantageous because in this case with consecutive torque impulses 10A, 10B, 10C more oscillation energy can be loaded in a cumulative manner into the mechanical oscillating circuit of the elevator system and consequently the detaching torque of the elevator car can be increased. In the mechanical oscillating circuit of the elevator system the masses of the car 3 and of the counterweight 4, among other things, vibrate at the frequency set by the spring constants of the flexible parts such as e.g. of the elevator ropes, belt or corresponding 15. FIG. 3*b* presents a speed signal 11 of a hoisting machine 1 of an elevator as a response to the current pulses 10A, 10B, 10C producing the torque of FIG. 3*a*. The speed signal 11 is measured with an encoder, which is mechanically in contact with a rotating part of the hoisting machine 1. Here an individual current pulse 10A, 10B, 10C is disconnected always when the speed signal 11 of the hoisting machine decreases to almost zero, in a situation in which the elongation of the elevator ropes, belt or corresponding 15 between the elevator car 3 and the traction sheave of the hoisting machine 1 essentially reaches its maximum point. Since the consecutive current pulses 10A, 10B, 10C to be supplied in a cumulative manner load the mechanical oscillating circuit of the elevator system with more energy, also the amplitudes of the consecutive speed pulses 11 in response to the current pulses 10A, 10B, 10C increase, and consequently the detaching torque of the elevator car 3 increases also.

Figure 4:
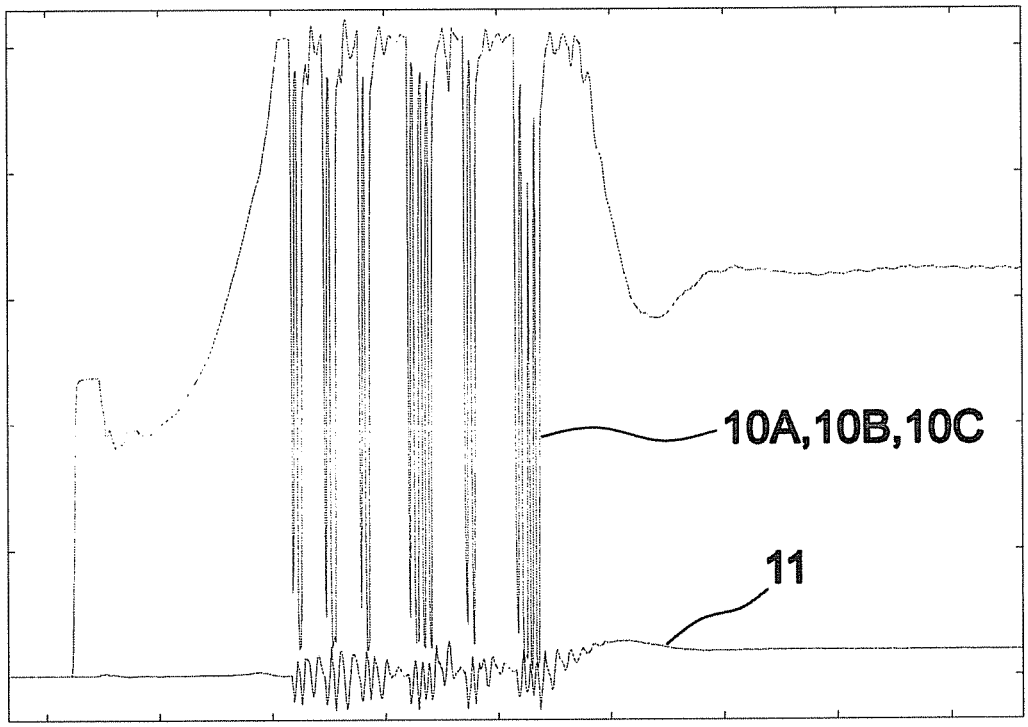
FIG. 4 presents the measurement results of one detaching operation of a gripped stuck elevator car

FIG. 4 presents the measurement results of one detaching operation of a gripped stuck elevator car in an elevator system e.g. according to FIG. 1. Torque impulses 10A, 10B, 10C are produced with the hoisting machine of the elevator by supplying with the frequency converter 2 current pulses to the permanent-magnet synchronous motor of the hoisting machine 1, e.g. in the manner described in the embodiments of FIGS. 3*a*, 3*b*. The speed 11 of the hoisting machine 1 of the elevator produced by a torque impulse is also measured, and the detaching function is ended when it is observed that the elevator car 3 has detached from the safety gear. Detachment of the elevator car 3 from the safety gear is detected such that the speed 11 of the hoisting machine 1 increases over the set ending limit. Instead of the measurement 11 of the speed of the hoisting machine of the elevator, the speed of the elevator car 3 could also be measured e.g. directly with an encoder connected between the elevator car and the guide rail or with an encoder connected to the rope pulley of the overspeed governor 7.

The detaching function of the elevator car 3 can be started e.g. from a service center 17 by sending an activation signal from the service center 17 via a wireless link between the service center and the elevator control unit 8 of the elevator system. The detaching function of the elevator car 3 could also be started e.g. by sending an activation signal from the operating panel 9 of the elevator control unit 8, via a serial communication bus 16 between the elevator control unit 8 and the frequency converter 2. For example, a so-called MAP (maintenance access panel) user interface that is intended for a serviceman can also be used as an operating panel 9. The operating panel 9 can be disposed e.g. on a stopping floor of the elevator or in the machine room, in which case the detaching operation of the elevator car can be started from outside the elevator hoistway 12. The detaching function can be activated e.g. by first sending an activation parameter from the MAP user interface via the serial communication bus 16 to the inverter control 13 of the frequency converter, after which the detaching function is started from the MAP user interface with the emergency drive switches (RDF switches). If emergency drive upwards is in this case selected with the emergency drive switches, the hoisting machine 1 of the elevator starts to produce torque impulses 10A, 10B, 10B that endeavor to pull the elevator car upwards; correspondingly, when selecting emergency drive downwards the torque impulses also act downwards with respect to the elevator car.

In the preceding the invention is described in connection with a safety gear 5 of an elevator car; however, by means of the invention e.g. a counterweight 4 can also be detached from a safety gear 14 in a corresponding manner.

The operation of the safety gear 5, 14 can be observed e.g. by measuring the state of a sensor, such as a safety switch, fitted in connection with the safety gear. An observation of the operation of the safety gear 5, 14 can therefore also be used for cancelling a gripping situation. The consequences of gripping can also be inspected e.g. by remote contact from a service center 17 by means of camera monitoring. Information about the gripping can also be sent from the elevator control unit 8 to the service center 17, e.g. via a wireless link.

In the preceding the invention is described in connection with an elevator system with counterweight; the solution according to the invention is also suited, however, to elevator systems without counterweight.

The preceding embodiment of FIG. 2 describes the structure and operation of a safety gear 5 of an elevator car in particular. Generally the safety gear 14 of the counterweight is also similar in its structure and operation to the aforementioned safety gear 5 of an elevator car.

The invention is not limited solely to the embodiments described above, but instead many variations are possible within the scope of the inventive concept defined by the claims below.

The invention claimed is:

1. A method in connection with an elevator system, the method comprising:

producing torque impulses with a hoisting machine of an elevator, for detaching a gripped stuck elevator car and/or a gripped stuck counterweight, wherein the torque impulses are produced with the hoisting machine for detaching the elevator car and/or the counterweight, which is gripped stuck as a consequence of operating a safety gear.

2. The method according to claim 1, wherein:

the torque impulses are produced with the hoisting machine of the elevator, which torque impulses act on the elevator car and/or on the counterweight in an opposite direction with respect to a propagation direction of the gripping.

3. The method according to claim 1, further comprising:

sending information regarding the gripping of the elevator car and/or of the counterweight to a service center.

4. The method according to claim 1, wherein:

the torque impulses are produced with the hoisting machine of the elevator by supplying pulse-like current to the hoisting machine of the elevator.

5. The method according claim 1, further comprising:
activating the detaching function of a gripped stuck elevator car and/or of a gripped stuck counterweight from a service center.

6. The method according to claim 1, further comprising:
activating the detaching function of a gripped stuck elevator car and/or of a gripped stuck counterweight with a user interface of an elevator control unit.

7. The method according to claim 1, further comprising:
producing consecutive torque impulses at a frequency, which corresponds to a resonance frequency of a mechanical vibration of the elevator system.

8. The method according to claim 1, further comprising:
measuring the movement of the hoisting machine and/or of the elevator car produced by the torque impulse,
wherein the detaching function of the gripped stuck elevator car and/or of the gripped stuck counterweight is ended when a magnitude of the movement of the hoisting machine and/or of the elevator car increases over an ending limit.

9. The method according to claim 1, further comprising:
measuring the movement of the hoisting machine produced by a torque impulse,
wherein an individual torque impulse is disconnected when a speed of the hoisting machine decelerates to below a disconnection limit.

10. An elevator system, comprising:
an elevator car;
a hoisting machine, for moving the elevator car in an elevator hoistway;
a safety gear, for stopping a movement of the elevator car;
a power supply appliance, which is connected to the hoisting machine, for producing torque with the hoisting machine; and
a controller, which is fitted in connection with a power supply apparatus,
wherein the controller is arranged to produce torque impulses with the hoisting machine of the elevator, for detaching a gripped stuck elevator car, and
the torque impulses are produced with the hoisting machine for detaching the elevator car, which is gripped stuck as a consequence of operating the safety gear.

11. An elevator system, comprising:
a counterweight;
a hoisting machine, for moving the counterweight in an elevator hoistway;
a safety gear for stopping a movement of the counterweight;
a power supply appliance, which is connected to the hoisting machine, for producing torque with the hoisting machine; and
a controller, which is fitted in connection with the power supply apparatus,
wherein the controller is arranged to produce torque impulses with the hoisting machine of the elevator, for detaching a gripped stuck counterweight, and
the torque impulses are produced with the hoisting machine for detaching the counterweight, which is gripped stuck as a consequence of operating the safety gear.

12. The elevator system according to claim 10, wherein the controller is arranged to produce torque impulses with the hoisting machine of the elevator, which torque impulses act on the elevator car and/or on a counterweight in an opposite direction with respect to a propagation direction of the gripping.

13. The elevator system according to claim 10, further comprises a rope or belt, for suspending the elevator car and/or a counterweight in the elevator hoistway.

14. The elevator system according to claim 10, wherein the controller comprises an input for an activation signal,
wherein the controller is arranged to activate the detaching function of a gripped stuck elevator car and/or of a gripped stuck counterweight after receiving the activation signal.

15. The elevator system according to claim 10, further comprises an elevator control unit,
wherein a data transfer channel is formed between the elevator control unit and the controller, for sending an activation signal from the elevator control unit to the controller.

16. The elevator system according to claim 15, wherein the elevator control unit comprises a user interface,
wherein the detaching function of a gripped stuck elevator car and/or of a gripped stuck counterweight is arranged to be activated as a result of an activation command given from the user interface.

17. The elevator system according to claim 15, wherein the elevator control unit is connected to a service center with a data transfer line,
wherein the detaching function of a gripped stuck elevator car and/or of a gripped stuck counterweight is arranged to be activated as a result of an activation command given from the service center.

18. The elevator system according to claim 10, further comprises a sensor that determines an operating status of the safety gear,
wherein the elevator control unit includes an input for a measuring signal of a sensor that determines the operating status of the safety gear.

19. The elevator system according to claim 10, wherein the controller is arranged to produce with the hoisting machine of the elevator consecutive torque impulses at a frequency, which corresponds to a resonance frequency of a mechanical vibration of the elevator system.

20. The elevator system according to claim 10, wherein the hoisting machine comprises a permanent-magnet synchronous motor for producing the torque that moves the elevator car.

21. A method in connection with an elevator system, the method comprising:
producing torque impulses with a hoisting machine of an elevator, for detaching a gripped stuck elevator car and/or a gripped stuck counterweight, and
producing consecutive torque impulses at a frequency, which corresponds to a resonance frequency of a mechanical vibration of the elevator system.

22. An elevator system, comprising:
a counterweight;
a hoisting machine, for moving the counterweight in an elevator hoistway;
a safety gear for stopping a movement of the counterweight;
a power supply appliance, which is connected to the hoisting machine, for producing torque with the hoisting machine; and
a controller, which is fitted in connection with the power supply apparatus,
wherein the controller is arranged to produce torque impulses with the hoisting machine of the elevator, for detaching a gripped stuck counterweight, and to produce consecutive torque impulses at a frequency, which corresponds to a resonance frequency of a mechanical vibration of the elevator system.

* * * * *